US010677495B2

(12) United States Patent
Diurlin et al.

(10) Patent No.: US 10,677,495 B2
(45) Date of Patent: Jun. 9, 2020

(54) STOVE

(71) Applicant: Nibe AB, Markaryd (SE)

(72) Inventors: Nils Diurlin, Strömsnäsbruk (SE); Carl Marcus Andreas Klarinsson, Hässleholm (SE)

(73) Assignee: NIBE AB, Markaryd (SE)

( * ) Notice: Subject to any disclaimer, the term of this patent is extended or adjusted under 35 U.S.C. 154(b) by 107 days.

(21) Appl. No.: 15/623,616

(22) Filed: Jun. 15, 2017

(65) Prior Publication Data

US 2017/0363325 A1 Dec. 21, 2017

(30) Foreign Application Priority Data

Jun. 16, 2016 (EP) ..... 16174688

(51) Int. Cl.

| | |
|---|---|
| ***F24C 1/14*** | (2006.01) |
| ***F24H 9/20*** | (2006.01) |
| ***F24B 1/19*** | (2006.01) |
| ***F24B 1/193*** | (2006.01) |
| ***F24B 1/187*** | (2006.01) |
| ***F23H 11/24*** | (2006.01) |

(Continued)

(52) U.S. Cl.

CPC ..... *F24H 9/2085* (2013.01); *F23H 11/24* (2013.01); *F23N 3/04* (2013.01); *F23N 3/047* (2013.01); *F24B 1/028* (2013.01); *F24B 1/187* (2013.01); *F24B 1/19* (2013.01); *F24B 1/193* (2013.01); *F24B 5/026* (2013.01); *F24H 3/006* (2013.01); *F23N 2225/16* (2020.01); *F23N 2235/06* (2020.01); *F23N 2241/02* (2020.01)

(58) Field of Classification Search

CPC ..... F24H 9/2085; F23H 11/24; F23N 3/047
See application file for complete search history.

(56) References Cited

U.S. PATENT DOCUMENTS

| | | | | |
|---|---|---|---|---|
| 3,624,742 A * | 11/1971 | Hurko | ..... | F24C 14/025 126/21 R |
| 6,216,684 B1 | 4/2001 | Champion | | |
| 2004/0003724 A1* | 1/2004 | Ellis | ..... | A01M 1/205 96/115 |

FOREIGN PATENT DOCUMENTS

DE 100 12 485 A1 9/2001

OTHER PUBLICATIONS

Pedersen English translation.*
Search Report dated Nov. 23, 2016 issued in corresponding European Application No. 16174688.8.

* cited by examiner

*Primary Examiner* — Jason Lau
(74) *Attorney, Agent, or Firm* — Nath, Goldberg & Meyer; Joshua B. Goldberg; Tanya E. Harkins

(57) ABSTRACT

A stove for indoor use includes a housing having a bottom wall, a top wall and one or more side walls defining a combustion chamber adapted to retain a fire, and an air supply system for supplying air to the combustion chamber. The air supply system includes a primary air conduit for supplying air to the combustion chamber from below through the bottom wall and a secondary air conduit for supplying air to the combustion chamber from above. A valve is arranged in the primary air conduit or in a branching between the primary and secondary air conduits. The valve is controlled by a bimetal whereby the valve is in a maximum open position when the prevailing temperature is below a first predetermined temperature during start-up of a fire and in a maximum closed position when the prevailing temperature is above a second predetermined temperature after start-up of the fire.

14 Claims, 6 Drawing Sheets

(51) Int. Cl.

| | |
|---|---|
| ***F23N 3/04*** | (2006.01) |
| ***F24B 1/02*** | (2006.01) |
| ***F24B 5/02*** | (2006.01) |
| ***F24H 3/00*** | (2006.01) |

STOVE

FIELD OF THE INVENTION

The present invention relates to a stove for indoor use.

BACKGROUND OF THE INVENTION

An open fire has been used as a heating source in many homes since ancient times. However, in an open fire the fuel in form of firewood is consumed quickly and reproduces only a fraction of the energy in the form of radiant heat. Most of the energy disappears with the flue gases out through the chimney. An open fire also consumes a lot of the air in the room and this air must be replaced, which occurs with cold air from outside that penetrates through slots in doors and windows. This creates floor draft and coldness in the room.

Today, we often use a stove instead of an open fire as a secondary heating source in our homes. In stoves, the combustion of fuel typically takes place in a closed combustion chamber, which is provided with air from outside through the wall or bottom plate. In order to have an effective combustion process, it is important to regulate the amount of air supplied to the combustion chamber. One way of regulating the air supplied to the combustion chamber is to have the stove door partly open during the ignition of the fire and then to close the stove door when the fire has been established. However, modern houses are often very tight and designed with well defined active air removal system stipulating a specific air flow out of the house. In such modern house there is a slight under-pressure in the house. This under-pressure may also be caused by a strong kitchen fan. In such a house, it would not be acceptable to have the stove door partly open; it would counteract the active air removal system and the under-pressure in the house would draw smoke from the fire into the indoor environment instead of the smoke being removed via the chimney. Moreover, the habit of having the stove door partly open introduces safety hazards; a glow may jump out through the partly open stove door and cause a fire or the door may accidentally be opened fully introducing the risk of burning yourself on the fire.

To address this issue there exist a number of more or less complex designs where the air supply is regulated by different kinds of valves or throttles. The regulation of the combustion air is often made by one or more valves manually operated by one or more levers placed on the front of the stove.

DE202007003345U1 discloses an example of a manually operated valve. The air is supplied in a primary channel from below through a riddling gate and a secondary channel from above along the front of the combustion chamber. The supply of air in the channels is regulated by a damper operated via a knob on the front side of the stove so that the supply of air in the primary channel may be completely stopped and the supply of air in the secondary channel is throttled upon reaching a sufficient combustion temperature.

However, it is difficult for the user to perform this regulation correctly to achieve an efficient burning of the fire wood through the duration of the burning of the firewood. It is also common that the user is not aware of the need to adjust the air flow or that the user forgets to adjust the air flow after ignition of the fire. In any case it will result in a too rapid combustion of the firewood.

To address this issue there exist a number of more or less complex designs where the air supply is automatically regulated by different kinds of automatically controlled valves or throttles.

DE202015101389 U1 discloses a fireplace cassette for indoor use, where the combustion chamber is provided with two separate air flows from the outside, a primary channel for supplying air from below and a secondary channel for supplying air from above along with the front side of the fireplace cassette. These air supply channels are regulated by separate dampers controlled by a gel, whose volume increases with increased temperature in the combustion chamber so that the gel is pressing a spring, which in turn acts on a damper arm for adjusting the position of the dampers.

A similar system is disclosed in U.S. Pat. No. 4,265,213 in which a primary channel for supply of air from below and a secondary channel for supply of air from above along the front of the combustion chamber. Both channels have a common inlet but different dimensions for regulation of the air flow. The common inlet is regulated by a damper, having a plate mounted for rotation with a horizontal shaft centrally driven by a bimetallic temperature-activated coil.

DE10012485 A1 discloses an air supply controller for a stove. The controller consists of a bimetallic sensor that controls a valve dependent on the temperature in the combustion chamber for regulation of the supplying of outside air. This document discloses the use of three bimetallic controlled valves wherein all three valves are controlled to open for a greater air flow when the fire burns hot and wherein all three valves are controlled to close for a smaller air flow when the fire burns at a lower temperature.

WO 2008/046425 A2 relates to a method for controlling the supply of combustion air to a combustion chamber, where the air supply is controlled in accordance with a predetermined program as a function of the combustion time.

U.S. Pat. No. 6,216,684 B1 discloses a combustion system for burning firewood including a combustion chamber defined by front, rear and side walls, a ceiling and a bottom. An access door is provided for addition of fuel into the combustion chamber. A substantial amount of combustion air enters the combustion chamber near the top of the fuelling doors via apertures and is directed down the face of the fuelling doors providing cooling. This document discloses that when the fire is during start-up more air should be provided from above the combustion chamber. This document also discloses the use of bi-metallic coil or strip that controls the air flow such that less air is supplied from above the combustion chamber when the fire burns hotter.

These automatically control methods are complex, difficult and expensive to manufacture. It is also an object to control the air supply for obtaining a clean and complete combustion with maximum heat recovery. Moreover, the above automatically controlled systems are difficult to combine with manual operation, which e.g. may be desired when adding firewood to an almost burnt out fire.

SUMMARY OF THE INVENTION

It is an object of the present invention to provide a stove for indoor use where the above mentioned drawbacks are eliminated wholly or at least partly.

It is another object to provide a stove with an improved air flow control in the combustion chamber.

This and other objects, which will become apparent in the following, are accomplished by a stove as defined in the independent claim.

According to one aspect of the invention there is provided a stove adapted for indoor use, the stove comprising a housing having a bottom wall, a top wall and one or more side walls defining a combustion chamber adapted to retain a fire, an air supply system for supplying air to the combustion chamber, the air supply system comprising a primary air conduit for supplying air to the combustion chamber from below through the bottom wall, a secondary air conduit for supplying air to the combustion chamber from above, wherein the primary and secondary air conduits are connected to a common inlet, and a valve arranged in the primary air conduit or in a branching between the primary and secondary air conduits, wherein the valve is controlled by a bimetal which is affected by prevailing temperature in the stove, wherein the bimetal controls the valve such that the valve is in a maximum open position when the prevailing temperature is below a first predetermined temperature (T1) during start-up of a fire and in a maximum closed position when the prevailing temperature is above a second predetermined temperature (T2) after start-up of the fire, and wherein the first predetermined temperature (T1) is lower than the second predetermined temperature (T2).

Hereby is provided a fireplace with a controlled air flow with a fast ignition since air is supplied also underneath the firewood during ignition or start-up of the fire. This supply of air is automatically choked by the bimetal closing the valve to the maximum closed position when a fire is burning steadily and the air flow will then be supplied exclusively or to a greater extent from above the fire compared to when the valve is in the maximum open position, whereby the fire is prevented from burning too fast. With this regulation of the air flow it will be possible to light the fire in the fireplace with the door to the combustion chamber closed.

During ignition and start-up of the fire it is thereby possible to supply a significant amount of air to the fuel from below which results in a fast ignition. After ignition phase has ended it is thereby possible to supply the air from above instead to ensure that flammable gasses are burnt and not lost up the chimney. This is e.g. accomplished by air that is circulated from above over the front glass of the stove and a small amount of air that is supplied into the top portions of the flames from nozzles in the rear wall of the combustion chamber. The air that is circulated down along the front glass is also helping to remove soot and thereby keep the glass clean so that the fire can be seen through the front glass. The secondary air supply may e.g. be conducted from the bottom inlet through channels in the outer walls of the stove and is released above the fire. The supply of air to the primary and secondary air conduits may be taken from outside the house through a common pipe in the wall or the concrete slab providing air to the common inlet.

The control of air supply may with the above design be considered to be a combination of an automatic control system and a manual control system. The operator controls the supply of air to the stove by a valve on the outside of the stove by a manual operation and the bimetal controls the supply of air from below during ignition by an automatic operation controlled by the temperature in the oven. After ignition the operator may control the combustion rate in the stove by the manual controlled valve on the outside. This makes the fire operate at a higher temperature and it will be possible to get more heat energy from the firewood that is burning.

The fact that the supply of air from below during ignition is controlled by an automatically controlled valve helps the unskilled user to start the fire and helps the unskilled or the absentminded to adjust the air flow after ignition of the fire thereby avoiding a too rapid combustion of the fuel.

The first predetermined temperature (T1) may be between 30-65° C., preferably between 35-50° C.

The second predetermined temperature (T2) may be between 80-120° C., preferably between 80-110° C.

Since ignition or start-up of a fire depends on various factors such as the size of the fuel, moisture content of the fuel, chimney draft and the temperature of the air provided from outside, it is an advantage to control the supply of primary air during ignition by temperature.

The first predetermined temperature (T1) may be at least 10° C. lower, more preferably at least 20° C. lower, and most preferably at least 30° C. lower, than the second predetermined temperature (T2).

Hereby is provided a valve that is fully open during the ignition of the fire so that a sufficient amount of air is supplied from below the fire and that gradually closing when the fire starts burning and is completely closed when the fire is hot and all the air is supplied to the fire from above. In this way it is possible to have both a fast ignition and a clean combustion.

The common inlet may have an area of between 3-10 times an open area of the valve in its maximum open position.

Hereby it is possible to provide a significant amount of air supplied from below during ignition and start-up of a fire to ensure that enough oxygen is supplied.

An open area of the valve in its maximum closed position may be less than 10% of the open area of the valve in its maximum open position, preferably less than 5%, and most preferably 0%. This way there is achieved a significant change in the air flow in the start-up sequence and in the subsequent burning. In some cases it may be desirable to have some air from the below. In some cases it is desirable to have no air flow from below after the start-up sequence.

The primary air conduit may connect to the combustion chamber via a plurality of openings in the bottom wall, wherein the openings have a total area of between 1.1 and 5 times, preferably between 1.3 and 3 times an open area of the valve in its maximum open position. Thereby the primary air is securely supplied to the firewood through a plurality of openings in the bottom wall. These openings runs the risk of being clogged by ash from the fire and to ensure that air is supplied from below these openings may have a total area being greater than the open area of the valve in its maximum open position.

The valve may be a pinwheel air damper. This is a kind of valve that may be securely controlled by a bimetal to provide a maximum open position over a first temperature interval, a partly open position (which changes with changing temperature) over a second temperature interval and a closed position over a third temperature interval.

The bottom wall comprises a grate assembly comprising a first grate part, and a second grate part, wherein the first part is movable in a direction of movement relative to the second grate part, wherein the first grate part and the second grate part both extend in an essentially horizontal direction with the second part underlying the first part in a vertical direction of the stove, wherein the second grate part comprises a downwardly extending groove extending along the direction of movement and being intermittently interrupted along the direction of movement by through-going openings, wherein the first grate part comprises a plurality of through-going openings, each through-going opening partly overlying the groove and thereby providing a plurality of channels for a flow of primary air from below via the through-going openings and obliquely along the groove of the second grate part and via the through-going openings of the first grate part up to the combustion chamber.

It may be noted that this grate assembly may used as a separate entity of a stove. It may especially be used without the automatic bi-metal controlled system for supply of air from below during ignition. However, it is considered a preferred embodiment to combine the bi-metal controlled system and the grate assembly.

With this design removal of ash is simplified.

The first grate part may further comprise an ash scraper extending into the groove of the second grate part, whereby movement of the first grate part along the movement direction will cause the ash scraper to move along the groove and scrape any ash in the groove out of the groove and into the through-going openings interrupting the groove. This facilitates the supply of primary air from below and cleaning of the grate before a new fire is ignited.

The through-going openings of the first part may be provided with sidewalls extending downwardly to an upper surface of the second grate part thereby forming a top open compartment with a bottom formed by the upper surface of the second grate part. These through-going holes can be formed by a simple and cheap production method, for example by a straight forward casting process without any need for cores or complex forming of the casting tools.

One of the sidewalls of the through-going openings of the first part may extend into the groove thereby forming the ash scraper and an opposing one of the sidewalls of the through-going openings of the first part may extending above the groove thereby forming an opening for the obliquely oriented flow along the groove.

Hereby is provided an ash scraper in a simple way which does not require expensive production methods or expensive or complicated parts.

The second grate part may be rotatable about a centre axis extending along a normal of a portion of the bottom wall formed by the first and second grate part. This provides a compact solution where the first and second grate parts may be moved relative to each other without any need to provide any any additional space to allow for the relative movement.

The groove may extend along an arc around the centre axis. Hereby will ash collected in the groove by pushed by the ash scraper towards the openings when the second grate part. The rotation may only be about 10-15° about the centre axel to securely remove any ash in the groove.

The first grate part may be manually operated to be moved relative to the second grate part, wherein the stove further comprises a valve for additional supply of air from below, the valve being operable connected to the operation of the first grate part for opening and closing of the valve.

Hereby is provided a valve for supply of air from below also when the stove is warm and the valve controlled by the bimetal is closed. This can be used when adding more firewood to an almost burnt out fire, which requires additional supply of oxygen.

BRIEF DESCRIPTION OF THE DRAWINGS

The above, as well as additional objects, features and advantages of the present invention, will be better understood through the following illustrative and non-limiting description of currently preferred embodiments of the present invention, with reference to the appended drawings, where the same reference numerals will be used for similar elements.

DETAILED DESCRIPTION

Figure 1:
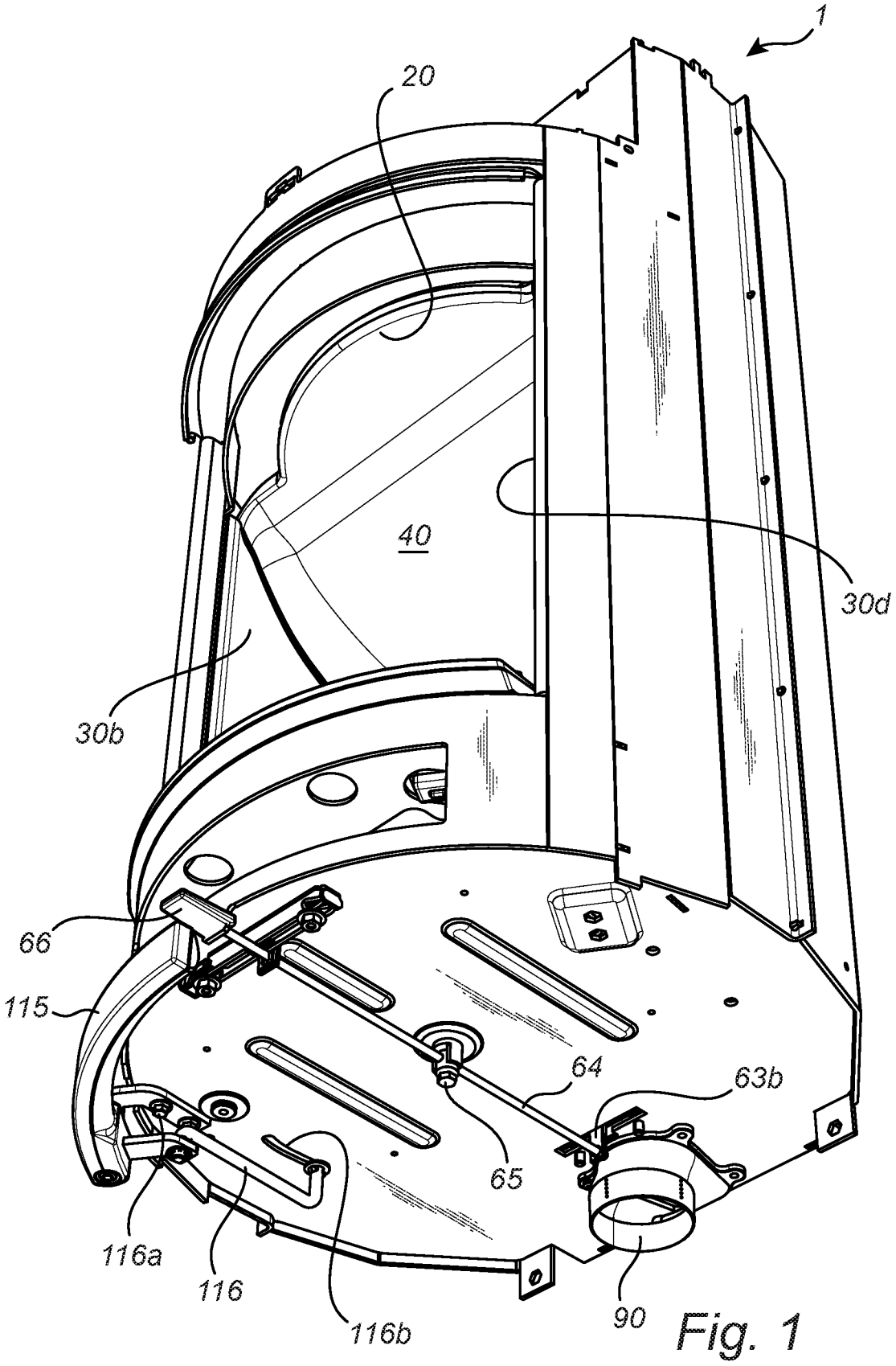
FIG. 1 is a perspective view from below of a stove.
Figure 2:
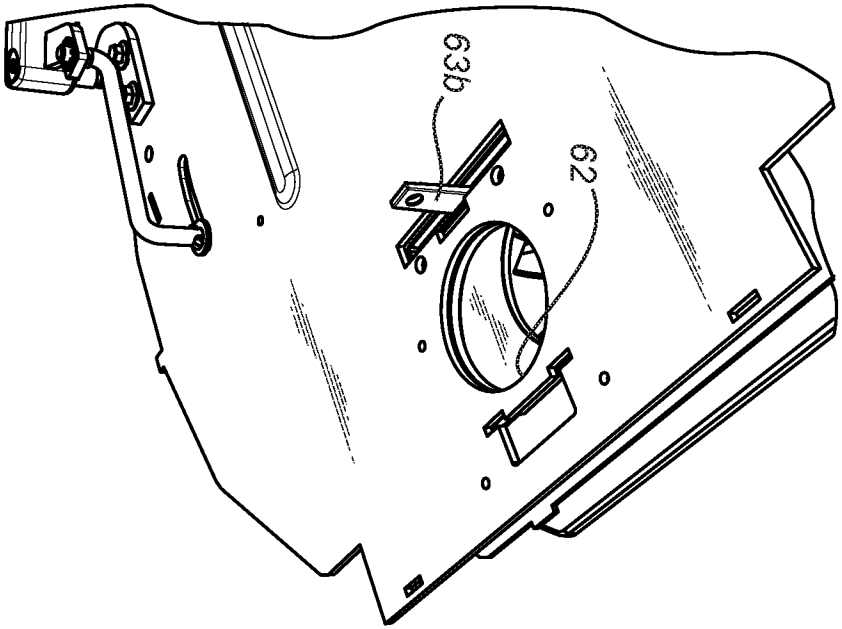
FIG. 2 is a perspective view from below of the air supply control system.
Figure 3A:
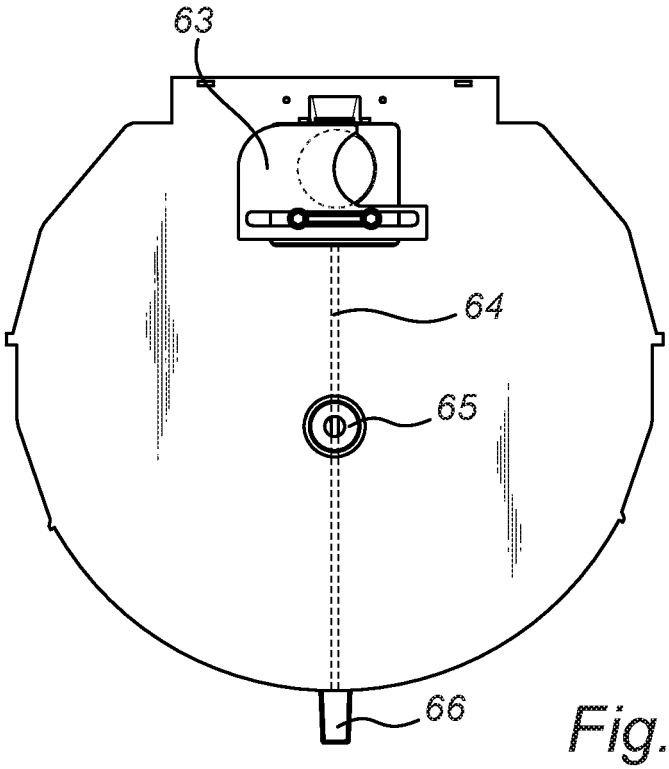
FIG. 3*a* is a view from above of the air supply control system in a partly closed position.
Figure 3B:
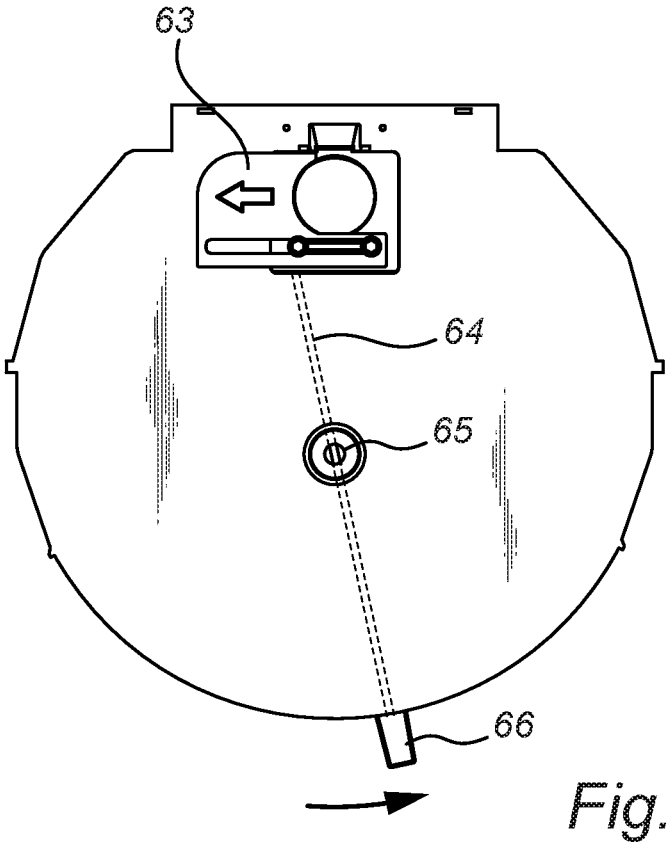
FIG. 3*b* is a view from above of the air supply control system in a fully open position
Figure 4:
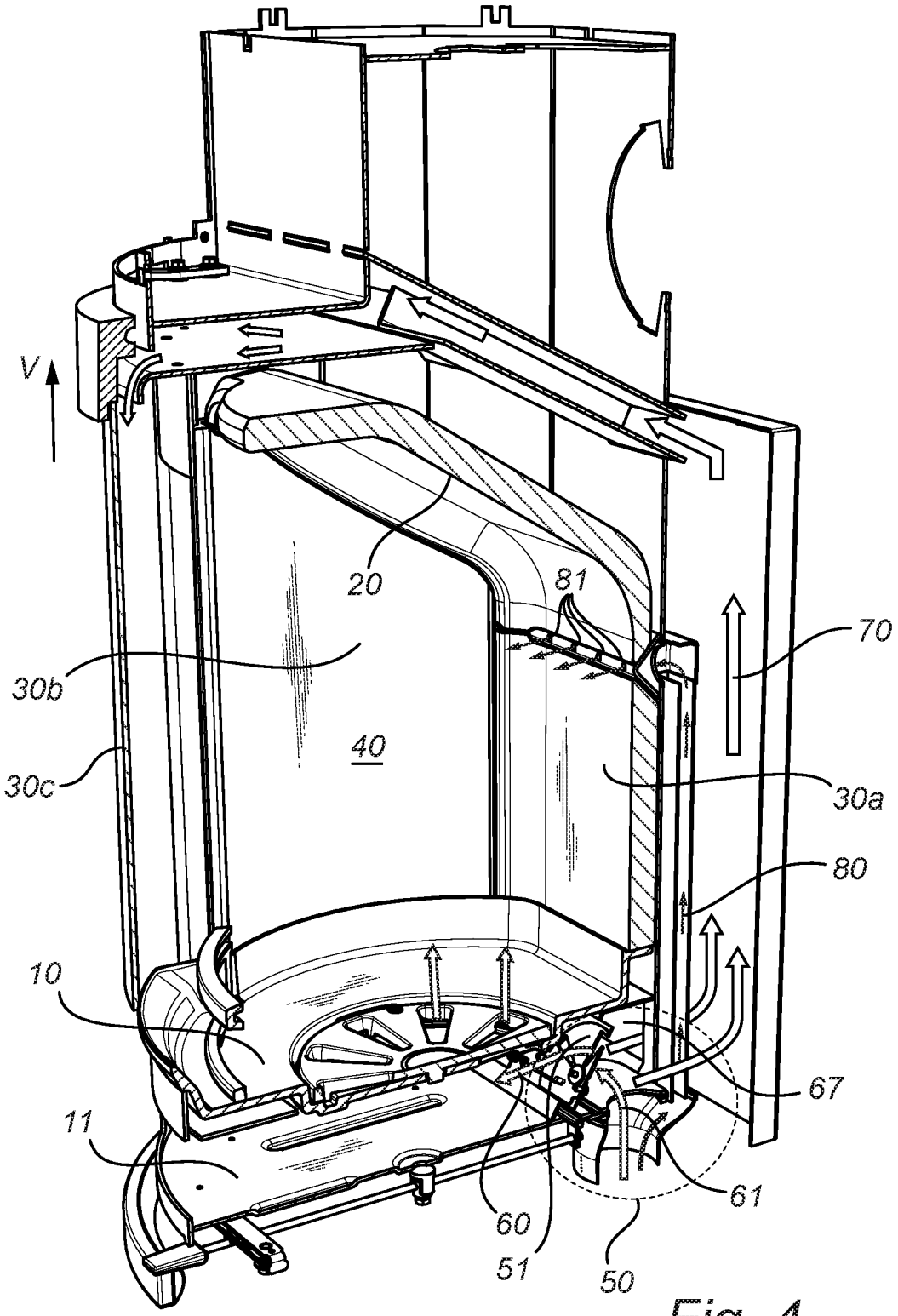
FIG. 4 is a cross-section showing the air conduits in the stove

As shown e.g. in FIG. 1 and FIG. 4 the stove 1 adapted for indoor use comprises a housing having a bottom wall 10, a top wall 20 and one or more side walls 30*a-d* defining a combustion chamber 40 adapted to retain a fire. The stove 1 also comprises an air supply system 50 for supplying air to the combustion chamber 40.

The air supply system 50 comprises a primary air conduit 60 for supplying air to the combustion chamber 40 from below through the bottom wall 10 and a secondary air conduit 70 for supplying air to the combustion chamber 40 from above.

The primary and secondary air conduits 60, 70 are connected to a common inlet 61, The size of the common inlet 61 is adjustable. As shown in FIGS. 1, 2, 3*a* and 3*b* the size of the opening 62 of the common inlet 61 may be manoeuvred to be fully or partly covered, such as with a throttle or valve plate 63. The valve plate 63 is manually operable. This is accomplished by a lever 64 which interacts with an arm 63*b* attached to the plate 63. The lever 64 is pivotable about a centre axis 65 such that the arm 63*b* and the plate 63 is moved to open or close the opening 62 when the lever 64 is manoeuvred by the use of a handle 66 positioned at the, relative to the arm 63*b*, opposite end of the lever 64.

The air supply system 50 also comprises a tertiary air conduit 80 for supplying air to an upper portion of the rear wall 30*a*.

The tertiary air conduit 80 is connected in parallel with the common inlet 60. Both the tertiary conduit 80 and the common inlet 60 are connected to a common main inlet 90. The tertiary air conduit 80 may but is not provided with any throttle or valve. However, when the user manoeuvres the valve plate 63 towards a more closed position a greater amount of air will prefer to enter into the tertiary conduit 80.

The tertiary air conduit 80 ends at the upper portion of the rear wall 30*a* with a plurality of small nozzles 81.

The tertiary air conduit 80 has an entrance opening with a cross-sectional area of about 300-400 $mm^2$. The total cross-sectional area of the nozzles 81 is about 50-150 $mm^2$. The opening 62 has a maximum open cross-sectional area of about 2000-3000 $mm^2$. The main inlet 90 has a cross-sectional area of about 3000-4000 $mm^2$.

The air supply system 50 also comprises a valve 51 arranged in the primary air conduit 60 or in a branching between the primary and secondary air conduits 60, 70.

Figure 5:
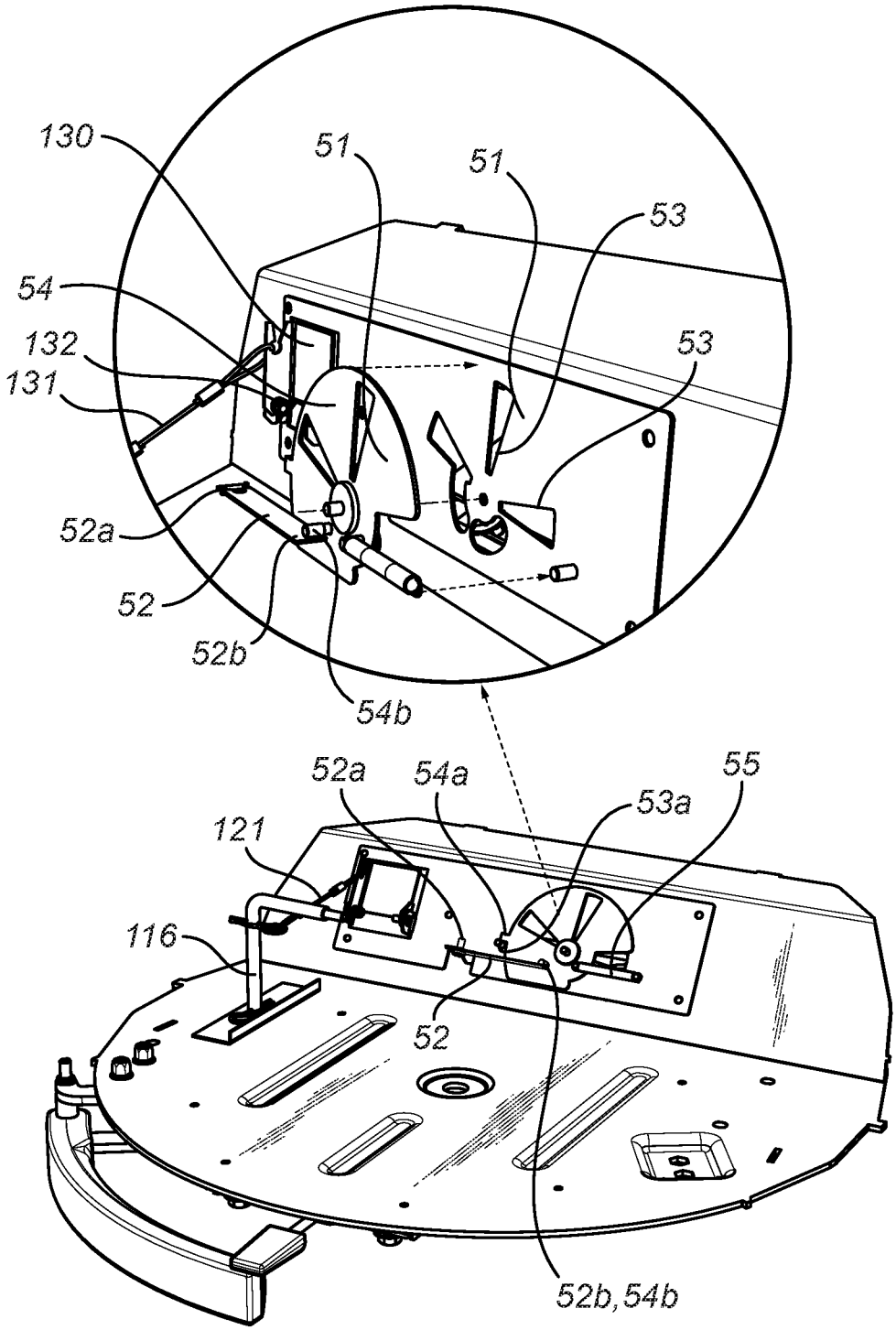
FIG. 5 shows details of a valve in a primary conduit.

In FIGS. 4 and 5 it is shown that the common inlet 61 leads into a box shaped volume 67 which extends below the bottom wall 10 along the rear side of the stove 1. The valve 51 is arranged in the wall of the box shaped volume 67 facing the volume 11 underneath the bottom wall 10. The secondary conduit 70 connects to the box shaped volume by large openings in the rearward facing walls of the box shaped volume 67.

The valve 51 is controlled by a bimetal body or blade 52 which is affected by prevailing temperature in the stove 10. The bimetal 52 controls the valve 51 such that the valve 51 is in a maximum open position when the prevailing temperature is below a first predetermined temperature (T1) of about 40° C. during start-up of a fire. When the bimetal reaches about 40° C. it will start to close the valve 51. The bimetal 52 controls the valve 51 such that the valve 51 is in a maximum closed position when the prevailing temperature of the bimetal 52 is above a second predetermined temperature (T2) of about 90-100° C. after start-up of the fire.

The valve 51 may be a so-called pinwheel air damper. Such a valve 51 has typically a first hole pattern in a first part 53 and a second, typically similar, hole pattern in a second part 54. The hole patterns are typically shaped as elongate openings extending radially about a central axis about which one of the two parts is rotatable relative to the other. As shown in FIG. 5, the bimetal 52 is at one end 52*a* fixed relative to one of the parts 53 and interacts at its other end 52*b* with the rotatable plate 54, such as via a pin 54*b* attached to the plate 54.

The valve 51 is shown in FIG. 5 in its open position. The plate 54 is urged in a counter clock wise rotation by a tension spring 55. The plate 54 has a protrusion 54*a* interacting with a pin 53*a* providing a stop against the force from the tension spring 55.

The pinwheel air damper 51 is designed such that adjacent holes in the hole pattern are separated by at least 45°, preferably at least 75°. Thereby it is possible to allow the bimetal to deform substantially at still preventing that the pinwheel air damper starts to open again due to excessive movement of the plate 54 such that a hole starts to overlap with the next hole of the hole pattern of the fixed part 53. This way of preventing the pinwheel air damper 51 from reopening when the temperature increases is desirable since there is in such a case no need for any stop-pin or disconnection between the plate 54 and the bimetal 52. However, such designs are of course also conceivable. In the shown embodiment the valve 51 is completely closed in its maximum closed position.

Figure 6A:
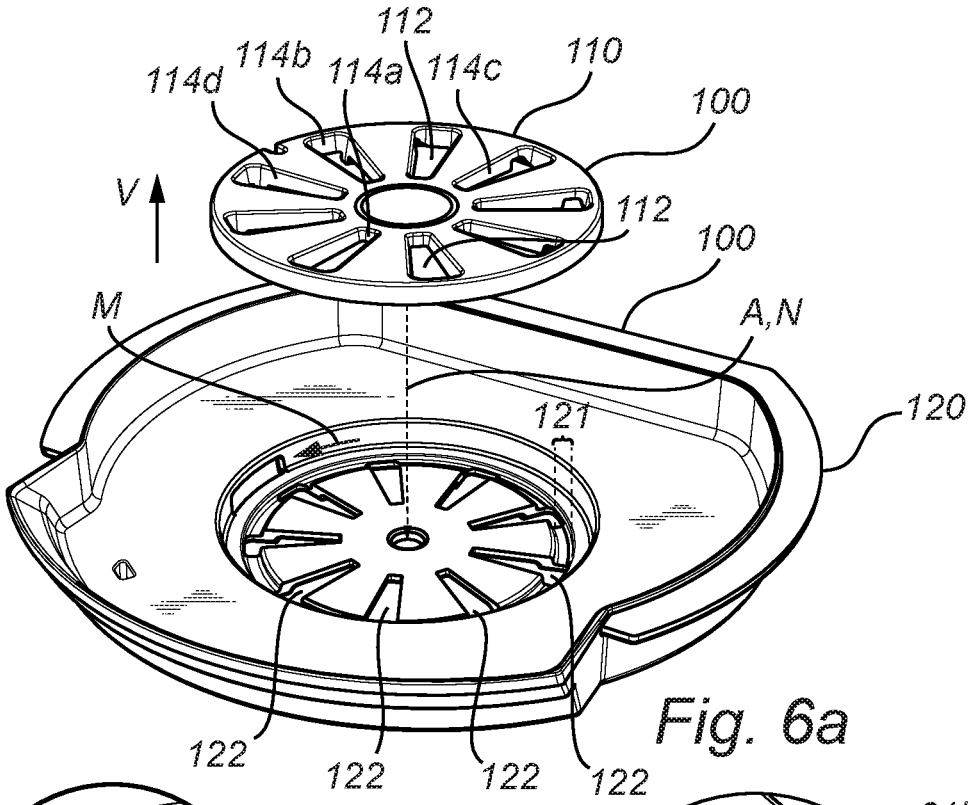
FIG. 6*a* shows in an exploded view a grate located at the bottom of the combustion chamber
Figure 6B:
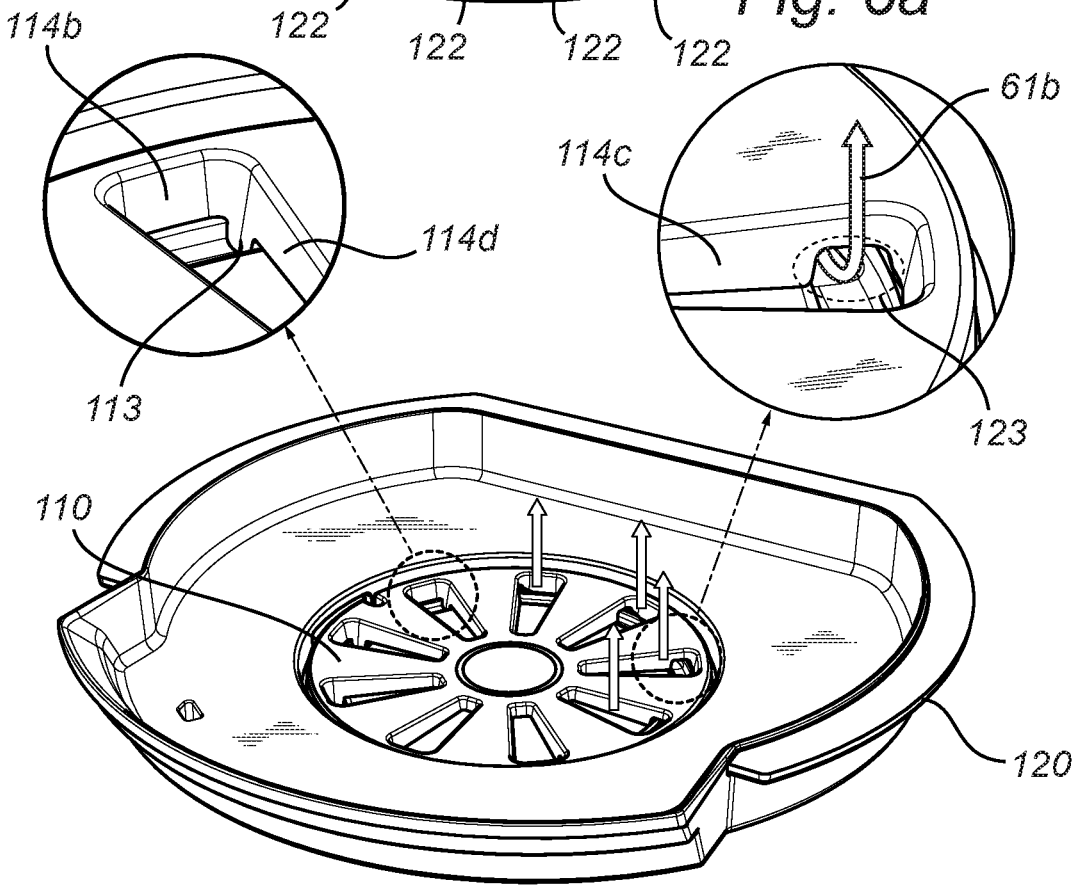
FIG. 6*b* shows the grate in assembled state.

As shown in FIGS. 4, 6*a* and 6*b*, the bottom wall 10 comprises a grate assembly 100 comprising a first grate part 110 and a second grate part 120. The first grate part 110 is movable in a direction M of movement relative to the second grate part 120 by being rotatable about a centre axis A extending along a normal N of a portion of the bottom wall 10 formed by the first and second grate parts 110, 120.

As shown in the figures, the first grate part 110 and the second grate part 120 both extend in an essentially horizontal direction with the second part 120 underlying the first part 110 in a vertical direction V of the stove 1.

The second grate part 120 comprises a downwardly extending groove 121 extending along the direction M of movement and being intermittently interrupted along the direction M of movement by through-going openings 122. The groove 121 extends along an arc around the centre axis A.

The first grate part 110 comprises a plurality of through-going openings 112, each through-going opening 112 partly overlying the groove 121 and thereby providing a plurality of channels 123 for a flow 61*b* of primary air from below via the through-going openings 122 of the second grate part 120 and obliquely along the groove 121 of the second grate part 120 and via the through-going openings 112 of the first grate part 110 up to the combustion chamber 10.

The first grate part 110 further comprises an ash scraper 113 extending into the groove 121 of the second grate part 120. Movement of the first grate part 110 along the movement direction M will cause the ash scraper 113 to move along the groove 121 and scrape any ash in the groove 121 out of the groove 121 and into the through-going openings 122 interrupting the groove 121.

As shown in FIGS. 6*a* and 6*b*, the through-going openings 112 of the first part 110 are provided with sidewalls 114*a-d* extending downwardly to an upper surface of the second grate part 120 thereby forming a top open compartment with a bottom formed by the upper surface of the second grate part 120.

As shown in the enlargement of FIG. 6*b*, one of the sidewalls 114*d* of the through-going openings of the first part 112 extend into the groove 121 thereby forming the ash scraper 113 and an opposing one of the sidewalls 114*c* of the through-going openings 112 of the first part 110 extending above the groove 121 thereby forming an opening 123 for the obliquely oriented flow 61*b* along the groove 121.

The primary air conduit 61 connects to the combustion chamber 40 via a plurality of openings 123 in the bottom wall 10, wherein the openings 123 have a total area of between 1.1 and 5 times, preferably between 1.3 and 3 times an open area of the valve 51 in its maximum open position. The total area of the openings 123 is about 700-1100 $mm^2$, preferably about 900 $mm^2$.

The first grate part 110 is manually operated to be moved relative to the second grate part 120 using a handle 115 and lever assembly 116. The handle 115 and lever 116 is shown in FIG. 1. The top part of the lever 116 is shown in FIG. 5. As shown in FIG. 1, when the handle 115 is drawn outwardly it will pivot about attachment point 116*a* and will thereby draw the lever 116 along the long hole 116*b*. The part of the lever 116 shown in FIG. 5 interacting with the first grate part 110 will thereby cause the first grate part 110 to rotate about 10-15° about the centre axis A in the counter clockwise direction such that the ash scrapers 113 scrape ash from the groove 121.

The stove 1 comprises a valve 130 for additional supply of air from below. The valve 130 is operably connected to the operation of the first grate part 110 for opening and closing of the valve 130. In FIG. 5, it is shown how a wire 121 is connected to the lever arm 116. When the user operates the handle 115 to rotate the first grate part 110, the lever 116 is moved, in the figure towards the handle 115. Thereby will the lever 116 tug the wire 131 and will thereby open the latch 130 forming the valve. The latch 130 is spring-loaded by springs 132 towards the closed position.

The person skilled in the art realizes that the present invention by no means is limited to the embodiment described above. For instance the fireplace may have another configuration and dimensions.

It may also be noted that in one embodiment, the stove is provided with the bimetal controlled valve but is not provided with the grate assembly. In another embodiment, the stove is provided with the grate assembly but is not provided with the bimetal controlled valve. In one embodiment the stove is provided with the grate assembly and the valve operably connected to the operation of the first grate part but is not provided with the bimetal controlled valve. In a preferred embodiment, the stove is provided with the bimetal controlled valve and with the grate assembly. In a preferred embodiment, the stove is provided with the bimetal controlled valve, the grate assembly and the valve operably connected to the operation of the first grate part.

The invention claimed is:

1. A stove adapted for indoor use, the stove comprising a housing having a bottom wall, a top wall and one or more side walls defining a combustion chamber adapted to retain a fire, an air supply system for supplying air to the combustion chamber, the air supply system comprising a primary air conduit for supplying air to the combustion chamber (40) from below through the bottom wall, a secondary air conduit for supplying air to the combustion chamber from above, wherein the primary and secondary air conduits are connected to a common inlet, wherein the air supply system further comprises a valve arranged in the primary air conduit or in a branching between the primary and secondary air conduits, wherein the valve is controlled by a bimetal which is affected by prevailing temperature in the stove, wherein the bimetal controls the valve such that the valve is in a maximum open position when the prevailing temperature is below a first predetermined temperature during start-up of a fire and in a maximum closed position when the prevailing temperature is above a second predetermined temperature after start-up of the fire, whereby the air flow from the common inlet will in the maximum closed position of the valve be supplied exclusively or to a greater extent from above the fire via the secondary air conduit connected to the common inlet compared to when the valve is in the maximum open position where a significant amount of air from the common inlet is supplied to fuel from below via the primary air conduit connected to the common inlet, wherein the first predetermined temperature is lower than the second predetermined temperature, and wherein the bottom wall comprises a grate assembly comprising a first grate part, and a second grate part, wherein the first grate part is movable in a direction of movement relative to the second grate part, wherein the first grate part and the second grate part both extend in an essentially horizontal direction with the second grate part underlying the first grate part in a vertical direction of the stove, wherein the second grate part comprises a downwardly extending groove extending along the direction of movement and being intermittently interrupted along the direction of movement by through-going openings, and wherein the first grate part comprises a plurality of through-going openings, each through-going opening partly overlying the groove and thereby providing a plurality of channels for a flow of primary air from below via the through-going openings and obliquely along the groove of the second grate part and via the through-going openings of the first grate part up to the combustion chamber.

2. Stove according to claim 1, wherein the first predetermined temperature is between 30-65° C., preferably between 35-50° C.

3. Stove according to claim 1, wherein the second predetermined temperature is between 80-120° C., preferably between 80-110° C.

4. Stove according to claim 1, wherein the first predetermined temperature is at least 10° C. lower, more preferably at least 20° C. lower, and most preferably at least 30° C. lower, than the second predetermined temperature.

5. Stove according to claim 1, wherein the common inlet has an area of between 3-10 times an open area of the valve in its maximum open position.

6. Stove according to claim 1, wherein an open area of the valve in its maximum closed position is less than 10% of the open area of the valve in its maximum open position, preferably less than 5%, and most preferably 0%.

7. Stove according to claim 1, wherein the primary air conduit connects to the combustion chamber via a plurality of openings in the bottom wall, wherein the openings have a total area of between 1.1 and 5 times, preferably between 1.3 and 3 times an open area of the valve in its maximum open position.

8. Stove according to claim 1, wherein the valve is a pinwheel air damper.

9. Stove according to claim 1, wherein the first grate part further comprises an ash scraper extending into the groove of the second grate part, whereby movement of the first grate part along the movement direction will cause the ash scraper to move along the groove and scrape any ash in the groove out of the groove and into the through-going openings interrupting the groove.

10. Stove according to claim 9, wherein the through-going openings of the first grate part are provided with sidewalls extending downwardly to an upper surface of the second grate part thereby forming a top open compartment with a bottom formed by the upper surface of the second grate part.

11. Stove according to claim 10, wherein one of the sidewalls of the through-going openings of the first grate part extend into the groove thereby forming the ash scraper and an opposing one of the sidewalls of the through-going openings of the first grate part extending above the groove thereby forming an opening for the obliquely oriented flow along the groove.

12. Stove according to claim 1, wherein the first grate part is rotatable about a centre axis extending along a normal of a portion of the bottom wall formed by the first and second grate parts.

13. Stove according to claim 12, wherein the groove extend along an arc around the centre axis.

14. Stove according to claim 1, wherein the first grate part is manually operated to be moved relative to the second grate part, wherein the stove further comprises a valve for additional supply of air from below, the valve being operably connected to the operation of the first grate part for opening and closing of the valve.

* * * * *